US011725894B2

(12) United States Patent
Kellgren

(10) Patent No.: US 11,725,894 B2
(45) Date of Patent: Aug. 15, 2023

(54) FIREARM MAGAZINE

(71) Applicant: Kel-Tec CNC Industries Inc., Cocoa, FL (US)

(72) Inventor: George Kellgren, Cocoa, FL (US)

(73) Assignee: KEL-TEC CNC INDUSTRIES, INC., Cocoa, FL (US)

( * ) Notice: Subject to any disclaimer, the term of this patent is extended or adjusted under 35 U.S.C. 154(b) by 0 days.

(21) Appl. No.: 17/842,912

(22) Filed: Jun. 17, 2022

(65) Prior Publication Data

US 2023/0070228 A1 Mar. 9, 2023

Related U.S. Application Data

(60) Provisional application No. 63/235,295, filed on Aug. 20, 2021, provisional application No. 63/223,740, filed on Jul. 20, 2021.

(51) Int. Cl.
*F41A 9/61* (2006.01)

(52) U.S. Cl.
CPC ..... *F41A 9/61* (2013.01)

(58) Field of Classification Search
CPC ..... F41A 9/61; F41A 9/65
USPC ..... 42/50, 49.02, 49.01
See application file for complete search history.

(56) References Cited

U.S. PATENT DOCUMENTS 7,509,767 B2 * 3/2009 Bolen ..... F41A 9/61 89/197

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

A firearm magazine includes an elongated tube defining a tube axis and having an upper end with feed lips and an opposed lower end. The tube has elongated front, rear, left and right side walls. A closure element is a bottom cap removably connected to the lower end of the tube and includes a latch movable between a retention position wherein the closure element is secured to the tube, and a released position wherein the closure element is removable from the tube. The closure element includes a spring loaded latch biased upward to lock into its retention position, and the closure element is slidably receivable onto the lower end of the tube by movement transverse to the tube axis in a removal direction. The latch is on a tube side opposite from the removal direction and configured to abut the tube to prevent removal when locked in its retention position.

20 Claims, 4 Drawing Sheets

B – B

A – A

DETAIL C

DETAIL C

DETAIL C

D – D

FIREARM MAGAZINE

CROSS-REFERENCE TO RELATED APPLICATIONS

This application claims the benefit of U.S. Provisional Patent Application No. 63/223,740, filed on Jul. 20, 2021, entitled "P15 STEEL MAGAZINE EXTENSION", and of U.S. Provisional Patent Application No. 63/235,295, filed on Aug. 20, 2021, entitled "P15 STEEL MAGAZINE EXTENSION", which is hereby incorporated by reference in its entirety for all that is taught and disclosed therein.

FIELD OF THE INVENTION

The present invention relates to detachable magazines for firearms.

BACKGROUND AND SUMMARY

Firearm magazine designs and configurations have been evolving and improving for well over a century since the implementation of fixed ammunition.

The ability of a detachable magazine to feed ammunition reliably is critical to the function of the firearm with which it is used, especially for rapid firing semi-automatic or fully automatic firearms. Detachable magazines for pistols, carbines, and rifles and the like have internal volumes which tend to accumulate gunpowder combustion byproducts and also other unwanted environmental material such as dust or soil particles when the firearm is used outdoors such as for hunting or in combat. The reliability and dependability of a firearm may be adversely affected by accumulation of such matter or by corrosion if combustion byproducts are allowed to remain in contact with unprotected metals, because even with modern ammunition these byproducts are usually chemically corrosive.

Firearms users therefore scrupulously and regularly clean and re-lubricate their tools after use, which includes disassembly and internal cleaning and inspection of any magazines used in the event. Most detachable magazines comprise an elongated tube defining a tube axis and having an upper end with feed lips and an opposed lower end, with the tube having opposed elongated front and rear walls, and opposed left and right side walls and a closure element removably connected to the lower end or the bottom of the magazine tube. The more difficult or complicated it is to remove the closure element, the harder and more onerous becomes the task of cleaning up after shooting. However, a design which allows a bottom closure to separate from the magazine tube too easily may come apart from the magazine at inopportune moments in hunting, competition, or in combat, creating a catastrophic failure of ammunition feeding function resulting from loss of spring pressure beneath the ammunition follower. Loss of a bottom closure of a magazine tube may even allow internal components of the magazine system and unfired ammunition to drop out the bottom of the magazine tube.

The above disadvantages are addressed by a providing the lower portion of the tube with a bottom closure which includes a latch movable between a dependable retention position in which the closure element is reliably secured to the tube, and a released position in which the closure element is easily removable from the tube for disassembly of the internal components of the magazine and generous access to the internal surfaces of the magazine tube for cleaning, lubrication, and inspection.

DETAILED DESCRIPTION OF A PREFERRED EMBODIMENT

Firearm magazine designs and configurations have been evolving and improving for well over a century since the implementation of fixed ammunition. Although the present invention is primarily directed to detachable magazines, the convenience of an easily removable bottom cap which is released and retained by the disclosed latching mechanism may also be utilized in firearms having a magazine tube or box which is more permanently or semi-permanently affixed to the receiver or stock of the firearm.

There has been a long felt need and persistent demand for improvements in detachable ammunition magazines for firearms which enable ease of disassembly of the magazine components and access to the inner volume of the magazine tube for cleaning and inspection. This increased ease of disassembly must not deleteriously weaken the ability of the assembly components to remain together during the physical shock environments and temperature ranges encountered in hunting, sport and competition shooting, and in combat actions. The reliability and dependability of the magazine to feed ammunition into the receiver while the firearm action is cycling also ought not be compromised by design improvements directed to allowing the components to be separated conveniently.

Figure 1:
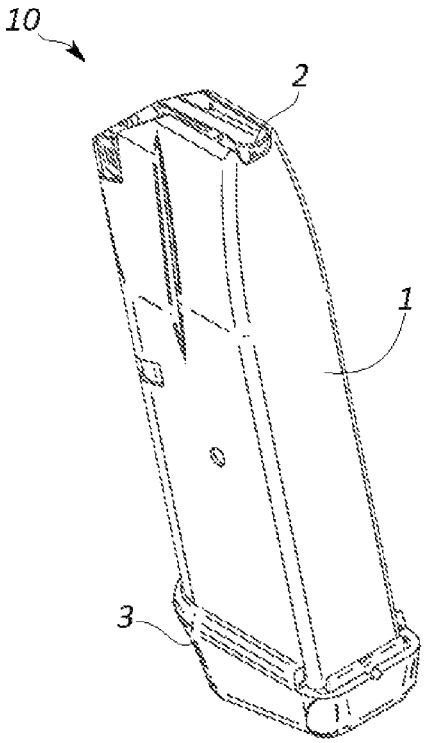
FIG. 1 shows an oblique, top left rear view of an embodiment of a firearm magazine in accordance with the invention.

Referring now to the drawings, FIG. 1 shows an oblique, top left rear view of an embodiment of a firearm magazine [10] in accordance with the invention. The magazine assembly comprises a magazine tube [1] which is an elongated tube having an upper end with feed lips and an opposed lower end, a magazine follower [2] having ammunition support features complementary to the cartridges stored in the magazine, a closure element [3] attachable to the lower end of the magazine tube, and a magazine follower spring operating in compression between the closure element and the underside of the follower so that as cartridges are expended the follower rises within the magazine tube to deliver a succession of ammunition rounds to the firearm receiver and its action. The closure element is removably connected to the lower end of the magazine tube.

Figure 2:
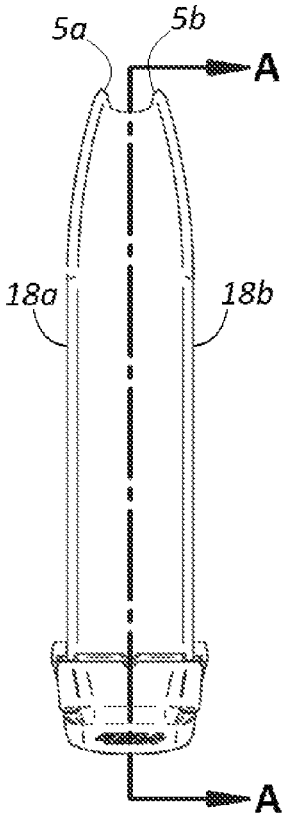
FIG. 2 shows a rear elevation view of the firearm magazine of FIG. 1 and defines section line A-A for the cross section view of FIG. 6.
Figure 6:
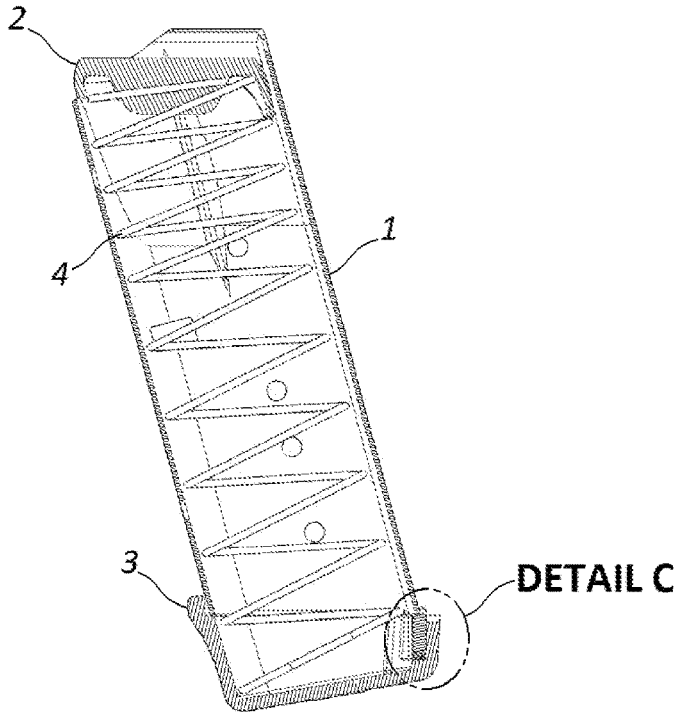
FIG. 6 shows a cross section view of the firearm magazine of FIG. 1 taken at section line A-A defined in FIG. 2, and defining a detail area C for FIGS. 7*a*, 7*b*, and 7*c*.

FIG. 2 shows a rear elevation view of the firearm magazine of FIG. 1 and defines section line A-A for the cross section view of FIG. 6. The magazine tube includes opposed left and right side walls [18*a*] and [18*b*] and feed lips [5*a*, 5*b*] at its upper end.

Figure 3A:
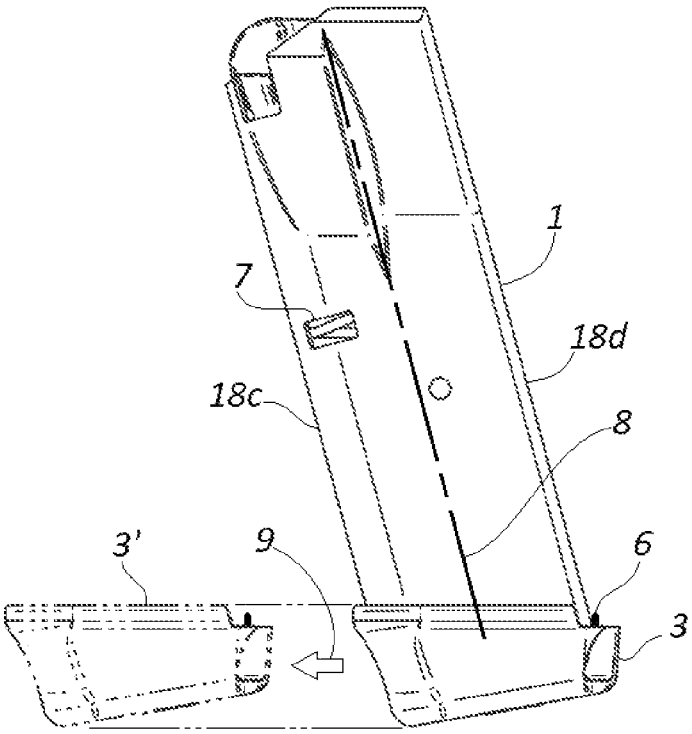
FIG. 3*a* shows a left elevation view of the firearm magazine of FIG. 1 with the lower closure element shown attached to the lower end of the magazine tube, and also shown in phantom lines to illustrate a detaching motion.

FIG. 3*a* shows a left elevation view of the firearm magazine of FIG. 1 with the lower closure element shown attached to the lower end of the magazine tube [1,] and also shown in phantom lines to illustrate a detaching motion. The magazine tube defines a tube axis [8] and the tube has opposed elongated front and rear walls [18*c*] and [18*d*.] The closure element [3] is slidably received on the lower end of the magazine tube for movement transverse to the tube axis in a removal direction shown by arrow [9.] The closure element is illustrated in phantom line at a detached and removed position [3'.] A latch component [6] is deposited within the closure element on a side of the tube opposite the removal direction. The latch is configured to abut the tube to prevent removal when in a retention position. According to this embodiment shown the closure element slides along the flanges, and the latch is aft of a lower edge of the rear wall of the tube when in its retention position. Except for excursions allowed by tolerances of component fits, the closure element cannot be moved any substantial distance while attached to the bottom of the magazine tube and while the latch resides in its retention position. The magazine tube includes one or more cutouts [7] which allow for visual inspection of the magazine follower spring or evince certain minimum quantities of ammunition retained within the magazine. When disassembling, a compressed magazine follower spring may escape from the magazine tube if the closure element is removed with no attempt to retain the spring. A pin, screwdriver, or other tool may be inserted into the cutout to catch one of the coils of the magazine spring and retard its expansion when the closure element is removed from the bottom of the tube. Some users lubricate their stored ammunition in a magazine, and these ports also allow an oil dropper tip for a user to add oil at an intermediate point among a plurality of stored rounds. Also, some firearms include gas passageways designed in the receiver which provide an exhaust pathway in the event of a cartridge rupture during firing, such as a case head separation accident. These ports then assist in exhausting gas flowing into the magazine tube from the breech of the weapon.

Figure 3B:
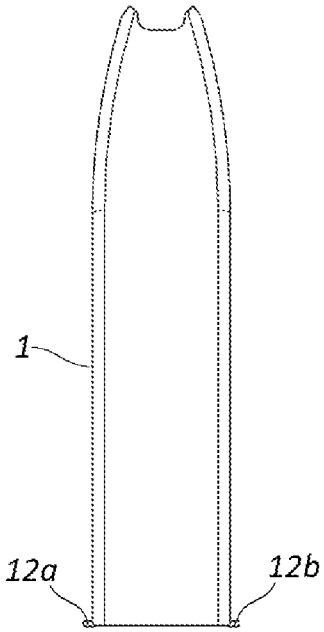
FIG. 3*b* shows a rear elevation view of the magazine tube component of the firearm magazine of FIG. 1.

FIG. 3*b* shows a rear elevation view of the magazine tube component [1] of the firearm magazine of FIG. 1. The right and left sidewalls each include a flange [12*a*] and [12*b*] at the bottom of the tube for engagement with undercuts or slots in the closure element. Such a configuration may also include a notch in the lower edge of the tube or a notch cut out along either or both flanges of the tube. A complementary feature in the slots of the closure element may be devised to provide a detent feel or a click-in noise or both, to signal to a user that the closure element has been securely mated to the magazine tube.

Figure 3C:
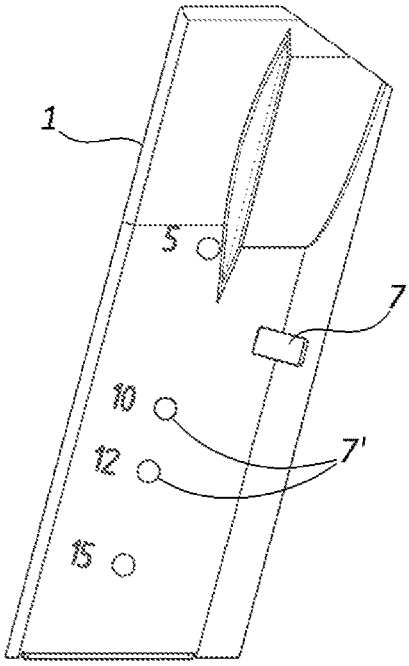
FIG. 3*c* shows a right elevation view of the magazine tube component of FIG. 3*b*.

FIG. 3*c* shows a right elevation view of the magazine tube component [1] of FIG. 3*b*. The tube sidewalls include an inspection port [7] for viewing the magazine follower spring or for retaining the spring with an inserted tool when disassembling the closure element from the bottom of the tube. Additional view ports [7'] may be provided the magazine sidewalls or end walls, with indica next to each port indicating the number of rounds held in the magazine when either the casing or the follower spring is visible at a particular view port.

Figure 4A:
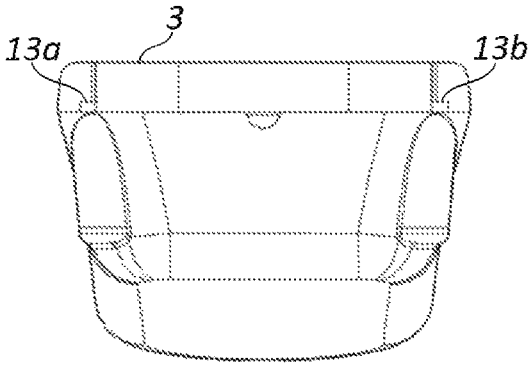
FIG. 4*a* shows a rear elevation view of the closure element component of the firearm magazine of FIG. 1.

FIG. 4*a* shows a rear elevation view of the closure element component [3] of the firearm magazine of FIG. 1. In the embodiment shown, the closure element has an upper edge which includes undercuts [13*a*] and [13*b*] which receive flanges of the bottom of tube sidewalls seen in FIG. 3*b*.

Figure 4B:
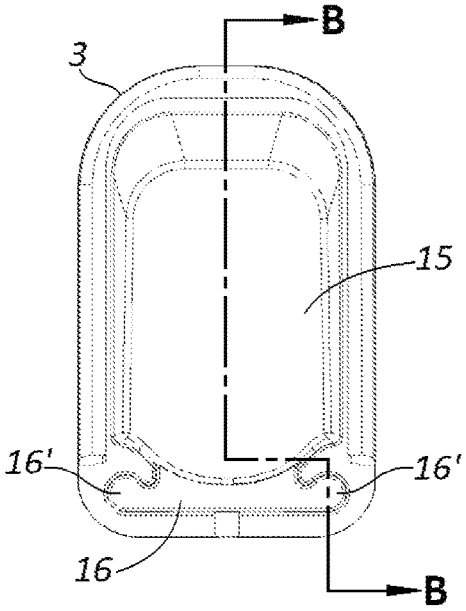
FIG. 4*b* shows a top view of the closure element component of FIG. 4*a* and defines offset section line B-B for the cross section view of FIG. 4*c*.
Figure 4C:
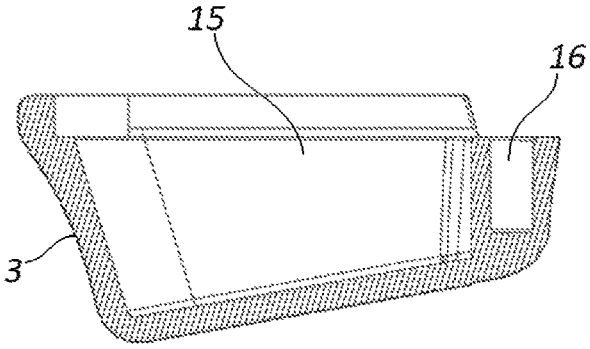
FIG. 4*c* shows a cross section of the closure element component of FIG. 4*a* taken at section line B-B defined in FIG. 4*b*.

FIG. 4*b* shows a top view of the closure element component [3] of FIG. 4*a* and defines offset section line B-B for the cross section view of FIG. 4*c*. The closure element defines a first pocket [15] below its upper edge and facing in an upward direction. This pocket receives a lower portion of the magazine follower spring. The closure element defines a second pocket [16] below the upper edge and receiving the latch The latch is biased upward by one or more latch springs and according to a preferred embodiment, two latch springs for engaging the lateral ends of the latch are deposited in silos [16'] which communicate with the latch pocket.

FIG. 4*c* shows a cross section of the closure element component [3] of FIG. 4*a* taken at section line B-B defined in FIG. 4*b*. The closure element has an upper edge and defines a first pocket [15] below the upper edge and facing in an upward direction. The closure element defines a second pocket [16] below the upper edge for receiving the latch.

Figure 5:
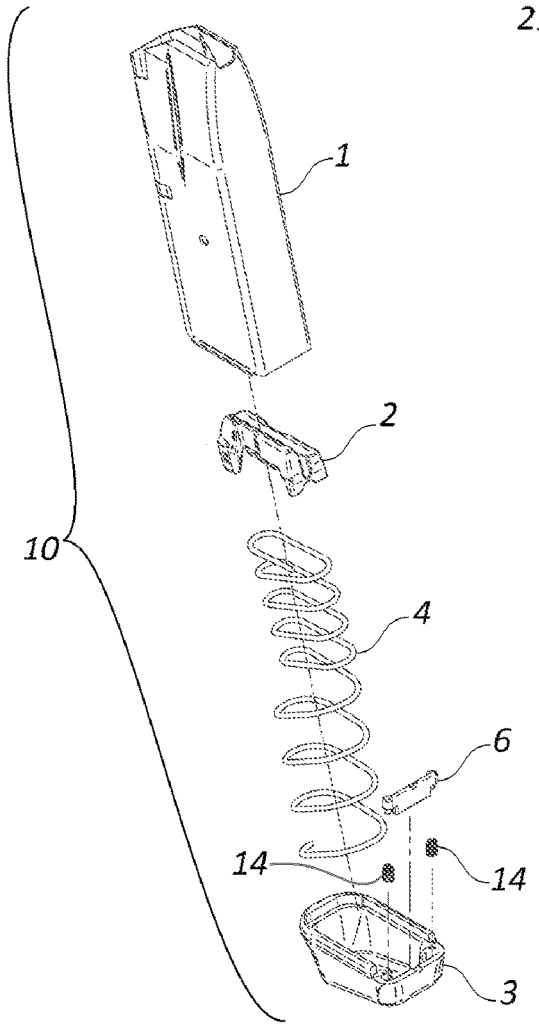
FIG. 5 shows an exploded view of the components of the firearm magazine of FIG. 1.

FIG. 5 shows an exploded view of the components of the firearm magazine of FIG. 1. The magazine assembly [10] comprises a magazine tube [1] which is an elongated tube having an upper end with feed lips and an opposed lower end, a magazine follower [2] having ammunition support features complementary to the cartridges stored in the magazine, a closure element [3] attachable to the lower end of the magazine tube, and a first magazine spring [4] juxtaposed between the follower and the closure element. The closure element is removably connected to the lower end of the magazine tube. At least one of the front, rear, left, and right walls of the magazine tube has a lower edge configured for engagement by a latch [6,] and in preferred embodiments the configuration includes rails or flanges on two opposed bottom edges of the magazine tube. At least one second spring [14] separate from the first magazine spring resides at least partially within the closure element and is configured to bias the latch.

Figure 7A:
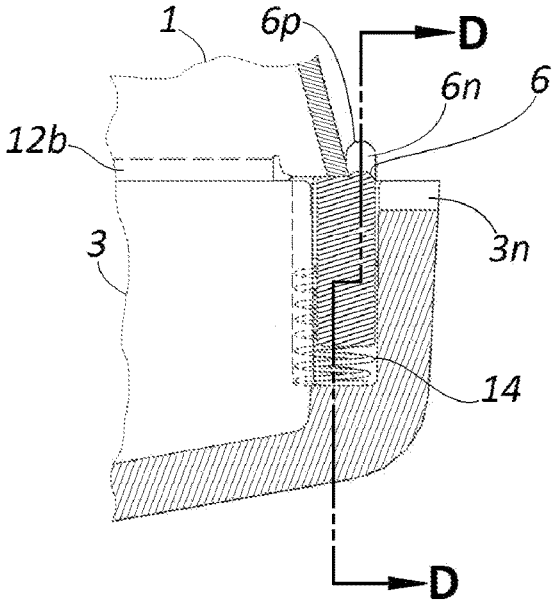
FIG. 7*a* shows an enlarged view of portions of the components seen in detail area C of FIG. 6, with the latch component residing in a retention position, and also defines offset section line D-D for the cross section view of FIG. 8.
Figure 7B:
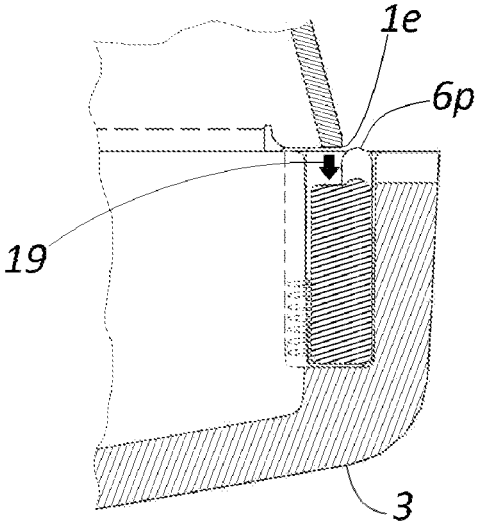
FIG. 7*b* shows an enlarged view of portions of the components seen in FIG. 7*a*, with the latch component residing in a released position.
Figure 7C:
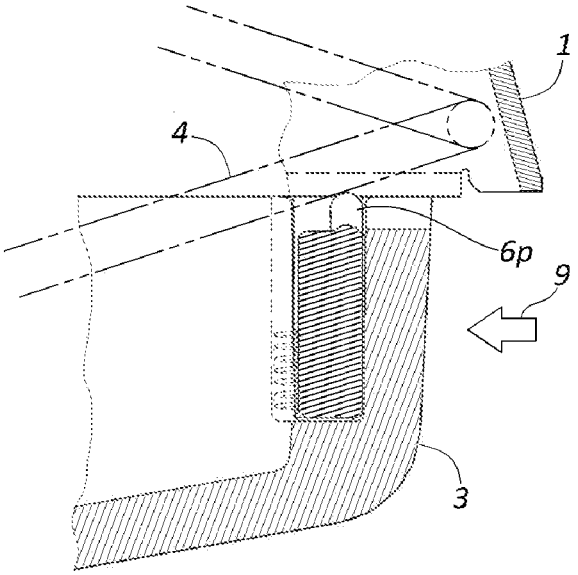
FIG. 7*c* shows an enlarged view of portions of the components seen in FIG. 7*a*, with the latch component residing in a released position, and the closure element being slidably removed from the magazine tube in a removal direction.

FIG. 6 shows a cross section view of the firearm magazine of FIG. 1 taken at section line A-A defined in FIG. 2, and defining a detail area C for FIGS. 7*a*, 7*b*, and 7*c*. The firearm magazine includes a follower [2] in the magazine tube [1,] and a closure element [3] attach-able and detachable from the bottom end of the magazine tube. The closure element has at least one upward facing pocket, and a magazine spring [4] in the tube has its lower end received in the pocket. The latch components are seen in Detail C and presented in the following enlarged views.

Figure 8:
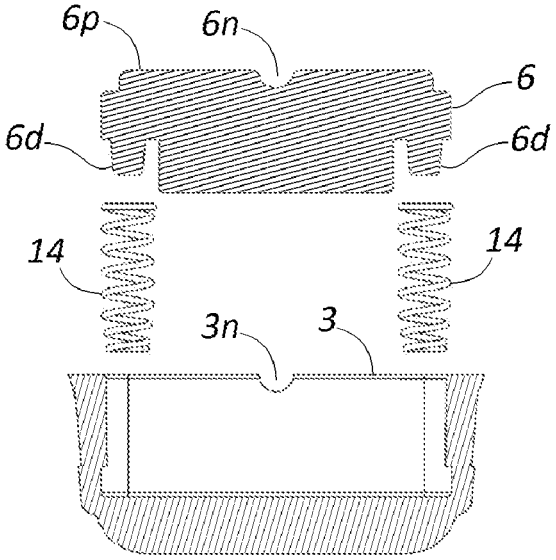
FIG. 8 shows an exploded view of cross sections of the components intersected by the section line D-D defined in FIG. 7*a*.

FIG. 7*a* shows an enlarged view of portions of the components seen in detail area C of FIG. 6, with the latch component [6] residing in a retention position, and also defines section line D-D for the cross section view of FIG. 8. The latch has an upper end portion which when in the retention position resides or protrudes above an adjacent portion of the lower end of the magazine tube [1,] but is depressible to a released position below this adjacent portion of the lower end of the tube. The latch has an upper portion [6*p*] protruding upwardly from the closure element when in the retention position, and the latch is recessed within the closure element when depressed into its released position. At least one latch spring [14] is deposited between the closure element and the latch so that the closure element is spring loaded to its retention position and biased toward the upper end of the tube. The closure element as an assembly may include the latch as a component movable between a retention position in which the closure element is secured to the tube, and a released position in which the closure element is removable from the tube. In a preferred embodiment, the upward protrusion of the latch includes a notch [6*n*] which is aligned or alignable with a corresponding or complementary notch [3*n*] in the closure element. To reduce accidental release of the closure element, the latch springs selected may be too stiff to be operated easily, for example by a user's finger or thumb depressing the latch into its pocket in the closure element. The adjacent pockets in the latch and closure elements expose a portion of the lower edge of the magazine tube to allow a tool such as a rod or screwdriver blade to be inserted so that high compression forces in the latch springs may be overcome. In embodiments having very high spring force, the latch may be depressed into its release position by inserting the tool tip through the notch in the latch and prizing against the lower edge of the magazine tube as a fulcrum. The tool then operates as a second order lever to depress the latch.

FIG. 7*b* shows an enlarged view of portions of the components seen in FIG. 7*a*, with the latch component depressed against latch spring forces residing in a released position. The motion of the latch from its retained position to its released position is shown by arrow [19.] The latch has an upper portion [6*p*] which becomes recessed within the closure element [3] when in the released position. In the release position the entirety of the latch resides beneath the bottom edge [1*e*] of the magazine tube proximal to the latch.

FIG. 7*c* shows an enlarged view of portions of the components seen in FIG. 7*a*, with the latch component residing in a released position, and the closure element [3] being slidably removed from the magazine tube [1] in a removal direction shown by arrow [9.] The latch in its released position resides entirely beneath the rear lower edge of the magazine tube, and the closure element and its recessed latch may be slid along the removal direction, and the closure element is thus removable from the tube.

Note that while the closure is being slid apart from the bottom of the magazine tube, a portion of the latch such as its upward protrusion [6*p*] may advantageously encounter an inclined portion of the coils of the magazine follower spring [4] so that the latch acts as a cam and the portion of the spring in contact with the latch acts as a cam follower. In this condition, sliding the closure element allows the latch to compress the magazine follower spring upward into the magazine tube, clearing the spring out of the way while the closure is disassembled from the magazine tube. Once separated, the latch and its latch springs may also be completely disassembled for cleaning and inspection.

FIG. 8 shows an exploded view of cross sections of the components intersected by the offset section line D-D defined in FIG. 7*a*. The latch [6] is a planar body having opposed lower corners [6*d*,] with a separate spring [14] below each lower corner. The upward protruding portion [6*p*] of the latch includes a notch [6*n*] which is aligned or alignable with a corresponding or complementary notch [3*n*] in the closure element [3.]

Many modifications and variations may be made to the invention as disclosed herein without departing from its spirit and scope. Thus, although many exemplary embodiments are described above, it will be appreciated that the invention is intended to cover all modifications and equivalents within the scope of the following claims.

I claim:

1. A magazine for a firearm comprising:

an elongated tube having an upper end with feed lips and an opposed lower end, and defining a tube axis; the tube having opposed elongated front and rear walls, and opposed left and right side walls;

a closure element removably connected to the lower end;

the closure element including a latch movable between a retention position in which the closure element is secured to the tube, and a released position in which the closure element is removable from the tube; and the latch being an elongated body extending from proximate the left wall to proximate the right wall.

2. The firearm magazine of claim 1, wherein the latch is spring loaded to the retention position.

3. The firearm magazine of claim 1, wherein the latch is biased toward the upper end of the tube.

4. The firearm magazine of claim 1, wherein the closure element is slidably received on the lower end for movement transverse to the tube axis in a removal direction, and wherein the latch is on a side of the tube opposite the removal direction and configured to abut the tube to prevent removal when in the retention position.

5. The firearm magazine of claim 1, wherein at least one of the front, rear, left, and right walls has a lower edge configured for engagement by the latch.

6. The firearm magazine of claim 1, wherein the right and left sidewalls each include a flange, the closure element slides along the flanges, and the latch is aft of a lower edge of the rear wall when in the retention position.

7. The firearm magazine of claim 1, wherein the latch has an upper end portion above an adjacent portion of the lower end of the tube when in the retention position and below the adjacent portion of the lower end of the tube when in the released position.

8. The firearm magazine of claim 1, including a follower in the tube, and a first magazine spring juxtaposed between the follower and the closure element, and including a second latch spring separate from the first magazine spring and configured to bias the latch.

9. The firearm magazine of claim 1, wherein the latch has an upper portion protruding upwardly from the closure element when in the retention position, and recessed within the closure element when in the released position.

10. The firearm magazine of claim 1, wherein the closure element has an upper edge and defines a first pocket below the upper edge and facing in an upward direction.

11. The firearm magazine of claim 10, wherein the closure element defines a second pocket below the upper edge and receiving the latch.

12. The firearm magazine of claim 10, including a magazine spring in the tube and having a lower end received in the pocket.

13. The firearm magazine of claim 1, wherein the latch is a planar body having opposed lower corners, with a separate spring below each lower corner.

14. The firearm magazine of claim 1, wherein the latch element operably engages the rear wall of the tube.

15. A magazine for a firearm comprising:

an elongated tube having an upper end with feed lips and an opposed lower end, and defining a tube axis;

the tube having opposed elongated front and rear walls, and opposed left and right side walls;

a closure element removably connected to the lower end;

the closure element including a latch movable between a retention position in which the closure element is secured to the tube, and a released position in which the closure element is removable from the tube; and the latch being a planar body.

16. The firearm magazine of claim 15, wherein the latch element operably engages the rear wall of the tube.

17. The firearm magazine of claim 15, wherein the latch has opposed lower corners, with a separate spring below each lower corner.

18. A magazine for a firearm comprising:

an elongated tube having an upper end with feed lips and an opposed lower end, and defining a tube axis;

the tube having opposed elongated front and rear walls, and opposed left and right side walls;

a closure element removably connected to the lower end;

the closure element including a latch movable between a retention position in which the closure element is secured to the tube, and a released position in which the closure element is removable from the tube; and the closure element defining a transverse elongated pocket receiving the latch.

19. The firearm magazine of claim 18, wherein the latch element operably engages the rear wall of the tube.

20. The firearm magazine of claim 18, wherein the latch is a planar body having opposed lower corners, with a separate spring below each lower corner.

* * * * *